US007549230B2

(12) United States Patent
Rager

(10) Patent No.: US 7,549,230 B2
(45) **Date of Patent: *Jun. 23, 2009**

(54) BOW SIGHT WITH FIBER OPTICS

(75) Inventor: Christopher A. Rager, Three Forks, MT (US)

(73) Assignee: Bear Archery, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/021,556

(22) Filed: Jan. 29, 2008

(65) Prior Publication Data

US 2008/0115373 A1 May 22, 2008

Related U.S. Application Data

(63) Continuation of application No. 11/541,477, filed on Sep. 29, 2006, now Pat. No. 7,343,686, which is a continuation of application No. 10/639,189, filed on Aug. 11, 2003, now Pat. No. 7,159,325, which is a continuation of application No. 10/196,333, filed on Jul. 16, 2002, now Pat. No. 6,892,462, which is a continuation of application No. 09/607,243, filed on Jun. 30, 2000, now Pat. No. 6,418,633.

(51) Int. Cl.
*F41G 1/467* (2006.01)

(52) U.S. Cl. ..... 33/265; 124/87; 42/136

(58) Field of Classification Search ..... 33/265; 124/87; 42/136–139
See application file for complete search history.

(56) References Cited

U.S. PATENT DOCUMENTS 3,234,651 A 2/1966 Rivers
3,455,027 A 7/1969 Perkins
3,475,820 A 11/1969 Kernan
3,521,362 A 7/1970 Duplechin
3,641,675 A 2/1972 Funk, Jr.
3,648,376 A 3/1972 Millnamow
3,945,127 A 3/1976 Spencer
3,997,974 A 12/1976 Larson
4,116,194 A 9/1978 Topel
4,120,096 A 10/1978 Keller
4,159,575 A 7/1979 Kalmbach
4,162,579 A 7/1979 James
4,177,572 A 12/1979 Hindes
4,215,484 A 8/1980 Lauffenburger
4,244,115 A 1/1981 Waldorf
4,291,664 A 9/1981 Nishioka
4,418,479 A 12/1983 Stachnik
4,541,179 A 9/1985 Closson
4,884,347 A 12/1989 Larson
4,928,394 A 5/1990 Sherman (Continued)

*Primary Examiner*—Randy W Gibson
(74) *Attorney, Agent, or Firm*—Woodard, Emhardt, Moriarty, McNett & Henry LLP

(57) ABSTRACT

A bow sight having a support structure, and two or more vertically aligned vertical pins connected to the support structure is provided. At least two of the vertical pins include a sight point. In accordance with another aspect of the invention, a bow sight having a support structure connected to two or more sight points is provided. The two or more sight points are rotationally adjustable such that they can be rotated into vertical alignment. In accordance with another aspect of the invention, a bow sight having a support structure, a sight point connected to the support structure, and a dampener is provided.

9 Claims, 9 Drawing Sheets

U.S. PATENT DOCUMENTS 4,977,678 A 12/1990 Sears
5,086,567 A 2/1992 Tutsch
5,103,568 A 4/1992 Canoy
5,131,153 A 7/1992 Seales
5,174,269 A 12/1992 Sappington
5,231,765 A 8/1993 Sherman
5,285,767 A 2/1994 Padilla
5,341,791 A 8/1994 Shafer
5,362,046 A 11/1994 Sims
5,367,780 A 11/1994 Savage
5,383,279 A 1/1995 Tami
5,442,861 A 8/1995 Lorocco
5,442,863 A 8/1995 Fazely
5,517,979 A 5/1996 Closson
5,560,113 A 10/1996 Simo et al.
5,579,752 A 12/1996 Nelson et al.
5,619,801 A 4/1997 Slates
5,632,091 A 5/1997 Brion et al.
5,634,278 A 6/1997 London
5,638,604 A 6/1997 Lorocco
5,644,849 A 7/1997 Slates
5,653,034 A 8/1997 Bindon
5,653,217 A 8/1997 Keller
5,676,122 A 10/1997 Wiseby et al.
5,685,081 A 11/1997 Winegar
5,718,215 A 2/1998 Kenney et al.
5,836,294 A 11/1998 Merritt
5,862,603 A 1/1999 Ellig
5,894,672 A 4/1999 Ellenburg et al.
5,924,234 A 7/1999 Bindon et al.
5,956,854 A 9/1999 Lorocco
5,996,569 A 12/1999 Wilson
6,000,141 A 12/1999 Afshari
6,016,608 A 1/2000 Lorocco
6,061,919 A 5/2000 Reichert
6,073,352 A 6/2000 Zykan et al.
6,119,672 A 9/2000 Closson
6,122,833 A 9/2000 Lorocco
6,145,208 A 11/2000 Savage
6,154,971 A 12/2000 Perkins
6,216,352 B1 4/2001 Lorocco
6,276,068 B1 8/2001 Sheliga
6,360,472 B1 3/2002 Lorocco
6,382,201 B1 5/2002 McPherson et al.
6,397,483 B1 6/2002 Perkins
6,418,633 B1 7/2002 Rager
6,421,946 B1 7/2002 LoRocco
6,443,142 B1 9/2002 Wiseby et al.
6,477,778 B1 11/2002 Lorocco
6,494,604 B2 12/2002 Khoshnood
6,508,005 B2 1/2003 Springer
6,560,884 B1 5/2003 Afshari
6,564,462 B1 5/2003 Henry
6,581,317 B1 6/2003 Slates
6,601,308 B2 8/2003 Khoshnood
6,634,110 B2 10/2003 Johnson
6,634,111 B2 10/2003 LoRocco
6,725,854 B1 4/2004 Afshari
6,892,462 B2 5/2005 Rager
6,938,349 B2 9/2005 Afshari
7,159,325 B2 1/2007 Rager
7,343,686 B2 * 3/2008 Rager ..... 33/265
7,360,313 B1 * 4/2008 Hamm et al. ..... 33/265
2005/0150119 A1 7/2005 Ellig et al.
2005/0183272 A1 8/2005 Meadows

* cited by examiner

BOW SIGHT WITH FIBER OPTICS

RELATED APPLICATIONS

This application is a continuation of application Ser. No. 10/639,189, filed Aug. 11, 2003, which is a continuation of application Ser. No. 10/196,333, filed Jul. 16, 2002, now U.S. Pat. No. 6,892,462, which is a continuation of application Ser. No. 09/607,243, filed Jun. 30, 2000, now U.S. Pat. No. 6,418,633, which applications are incorporated herein by reference.

FIELD OF THE INVENTION

The invention relates to a sight for a bow. In particular, the bow sight includes vertical sight points. The invention also relates to vertical sight points that are rotationally adjustable for the achievement of vertical alignment despite the amount of bow torque applied by the archer to the bow. The invention also relates to a bow sight including a dampener.

BACKGROUND OF THE INVENTION

This invention relates generally to the filed of archery equipment and more particularly to a novel sighting apparatus for use with an archery bow.

Bow sights generally have multiple sight points for use in shooting arrows into targets of different distances from the archer. Many bow sights include multiple sight points attached to horizontal pins. Bow sights with horizontal pins are shown in U.S. Pat. Nos. 5,103,568; 5,676,122; and 5,685,081.

A number of U.S. patents disclose bow sights having various other arrangements of sighting points. See, for example, U.S. Pat. Nos. 3,234,651; 4,120,096; 5,086,567; and 5,131,153.

SUMMARY OF THE INVENTION

A bow sight having a support structure, and two or more vertically aligned vertical pins connected to the support structure is provided. At least two of the vertical pins include a sight point.

In accordance with another aspect of the invention, a bow sight having a support structure connected to two or more sight points is provided. The two or more sight points are rotationally adjustable such that they can be rotated into vertical alignment.

In accordance with another aspect of the invention, a bow sight having a support structure, a sight point connected to the support structure, and a dampener is provided.

BRIEF DESCRIPTION OF THE DRAWINGS

FIGS. 10*a-d* are a rear view, front view, left view and right view respectively of a vertical pin according to the principles of the present invention.

DETAILED DESCRIPTION OF THE PREFERRED EMBODIMENT

In the following description of the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
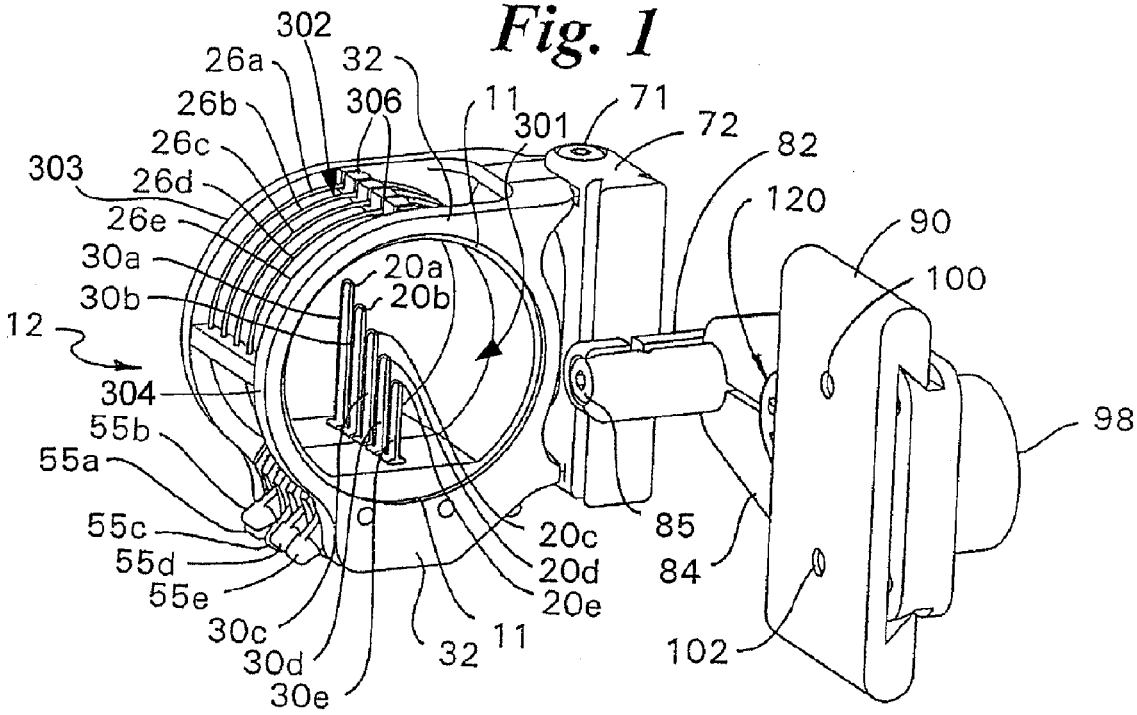
FIG. 1 is a perspective view of a bow sight according to the principles of the present invention.

A bow sight is a device that is attached to an archery bow and which provides one or more sight points. The archer uses the sight point(s) to aim at the target. A peep sight may be placed on the string of the bow such that the archer can sight through the peep sight and at the sight point with the target in the background. FIG. 1 shows a preferred embodiment of a bow sight 12. For purposes of this application, the view of the bow sight as seen from the archer in the shooting position is referred to as the front view of the bow sight.

A sighting point is any shape, point or indicia of any sort that is visually placed in line with the target to be shot at for assisting in the proper aiming of the bow. Sight points can be circular shapes, other geometrical shapes, colored dots, the end of a light gathering cable, or simply the end of a sight pin, for example.

In a preferred embodiment, the sight points 20*a-e* are formed by the ends of the fiber optic cables 26*a-e*. The fiber optic cables 26*a-e* collect light along their lengths and the light exits the end of the cables 26*a-e*. In this preferred embodiment, the ends of the fiber optic cables 26*a-e* are held in place by vertical pins.

A vertical pin is a member having a vertically elongated portion, wherein that member supports a sight point and wherein the sight point may be integral with or a separate piece from the vertical pin. A vertical pin could include features in addition to the fact that it has a length that is vertical. For example, a vertical pin could be an L-shaped pin with the horizontal portion of the L-shape extending in the direction toward the archer in the shooting position. See FIG. 8 for an example of an L-shaped pin that falls within the definition of a vertical pin.

Vertical pins have a significant advantage over horizontal pins because the field of view to the right and left of the vertical pins is very open for viewing the target and the environment of the target area.

In a preferred embodiment, the vertical pins 30*a-e* are linear vertical pins that define a hole in the uppermost end for receiving the ends of the fiber optic cables 26*a-e*.

In another preferred embodiment, the vertical pins are linear vertical pins that do not define a hole in the uppermost end. In this embodiment, the ends of the fiber optic cables 26*a-e* are glued or crimped to the ends of the vertical pins 30*a-e*.

A support structure is any structural member that supports a sight point. In a preferred embodiment, the support structure 32 is a generally circular shaped piece of acrylic that supports the vertical pins 30*a-e* which support the sight points 20*a-e* respectively. The circular shape of the support structure 32 provides protection of the vertical pins 30*a-e* from being damaged or bent while also providing a good view of the ultimate target through the interior portion of the circular support structure.

The point at which a vertical pin is attached to a support structure is the attachment point. Vertical pins can be attached to the support structure in many different orientations. Vertical pins can be attached to the support structure with the sight point below the attachment point or with the sight point above the attachment point. It is also within the scope of the present invention to have a bow sight with one or more vertical pins attached to the support structure with the sight point below the attachment point and one or more vertical pins attached to the support structure with the sight point above the attachment point.

It is often desired to adjust the sight point height associated with a particular vertical pin. These adjustments are made to "sight-in" the bow so that each sight point is accurately associated with a target of a particular distance. A vertical pin is "vertically adjustable" when the associated sight point for that vertical pin can be moved vertically up or down.

Figure 9:
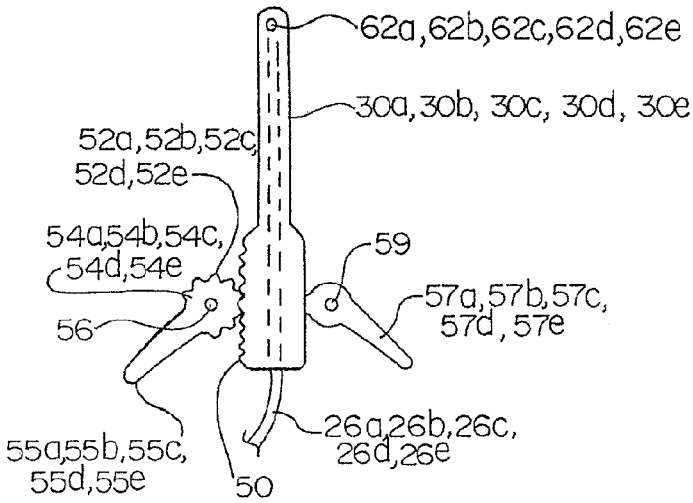
FIG. 9 is an exploded view of a vertical pin, an associated adjustment knob and an associated cam member according to the principles of the present invention.
Figure 9:
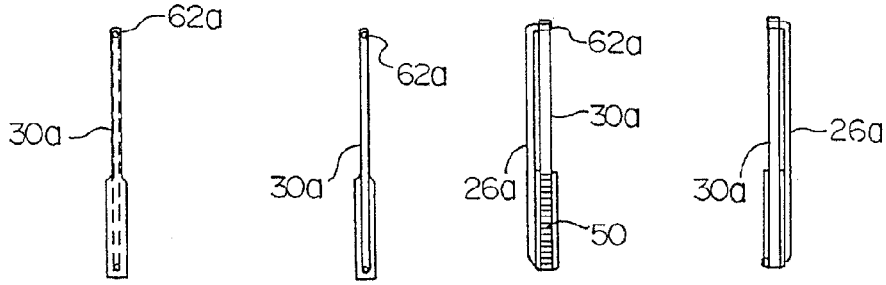

In a preferred embodiment, each of the vertical pins 30*a-e* is vertically adjustable by movement of the entire vertical pin. Each of the vertical pins 30*a-e* include gears, such as gears 50 on a vertical pin 30*a* as shown in FIG. 9. Likewise, the adjustment knobs 54*a-e* each include gears, such as gears 52 on adjustment knob 54*a* as shown in FIG. 9. The gears on vertical pins 30*a-e* interact respectively with the gears on the adjustment knobs 54*a-e* such that rotation of an adjustment knob results in linear vertical motion of the respective vertical pin. The adjustment knobs 54*a-e* also include levers 55*a-e* respectively. The levers 55*a-e* are each integral with the corresponding adjustment knobs 54*a-e*. The lever makes it easier to rotate the adjustment knob.

Figure 6:
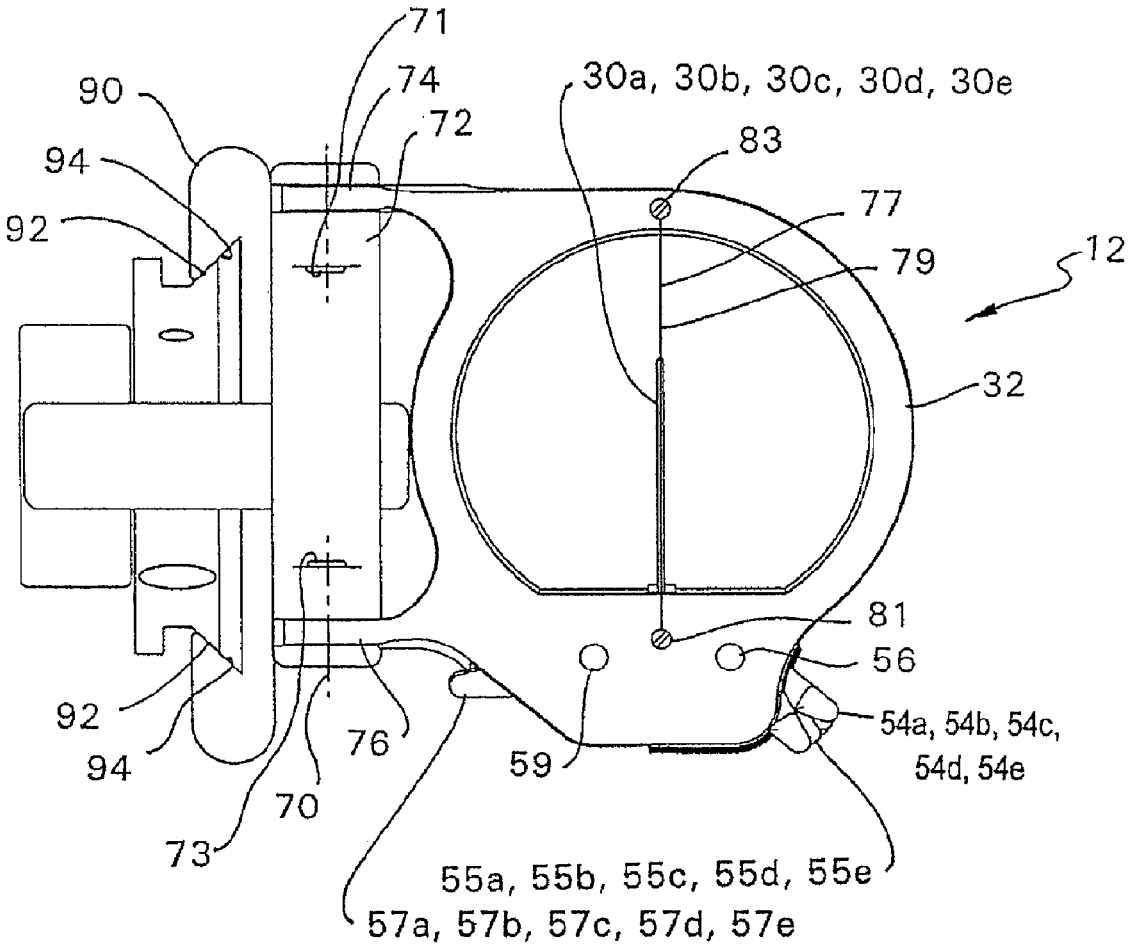
FIG. 6 is a back view of a bow sight according to the principles of the present invention and including a bow torque indicator.

As shown in FIG. 6, axis rod 56 extends through the center axis of the adjustment knobs 54*a-e*. The adjustment knobs 54*a-e* rotate around the axis rod 56.

The cam members 57*a-e* allow the archer to lock the vertical position of each vertical pin 30*a-e* respectively. The cam members 57*a-e* each comprise a cam portion 61*a-e* that rotates about an axis rod 59. Rotation of a cam member 57*a-e* results in engagement or disengagement of the respective cam portion 61*a-e* with the side of the vertical pin opposite the gears 50. The camming action allows the archer to prevent the vertical pins from moving once their vertical height is properly set.

In order to adjust the vertical position of a pin, the archer rotates the corresponding cam member, makes an adjustment of the vertical height of the pin by rotating the adjustment lever, and then rotates the cam member back into engagement with the vertical pin to hold the new vertical position. Once the pins are adjusted to the proper vertical position, it is of great importance that they not be accidentally moved. The cam members 57*a-e* accomplish this purpose by preventing rotation of the adjustment knobs 54*a-e* respectively.

Other means for prevention rotation of the adjustment knobs are contemplated. For example, a screw could be used in place of cam members 57*a-e*. Such screws (not shown) would extend perpendicular to the vertical pins and would extend through a hole in the support structure 32. Tightening of the screw associated with the vertical pin 30*a*, for example, would secure the vertical position of the sight point on vertical pin 30*a*. To adjust the height of vertical bin 30*a*, the associated screw is loosened and the adjustment knob 55*a* rotated.

In a preferred embodiment of the invention, the end of a light gathering cable is used as the sight point. A light gathering cable is any cable that collects light along the perimeter of its length and projects the light out the end of the cable. As discussed above, in a preferred embodiment, the light gathering cable is a fiber optic cable.

Figure 2:
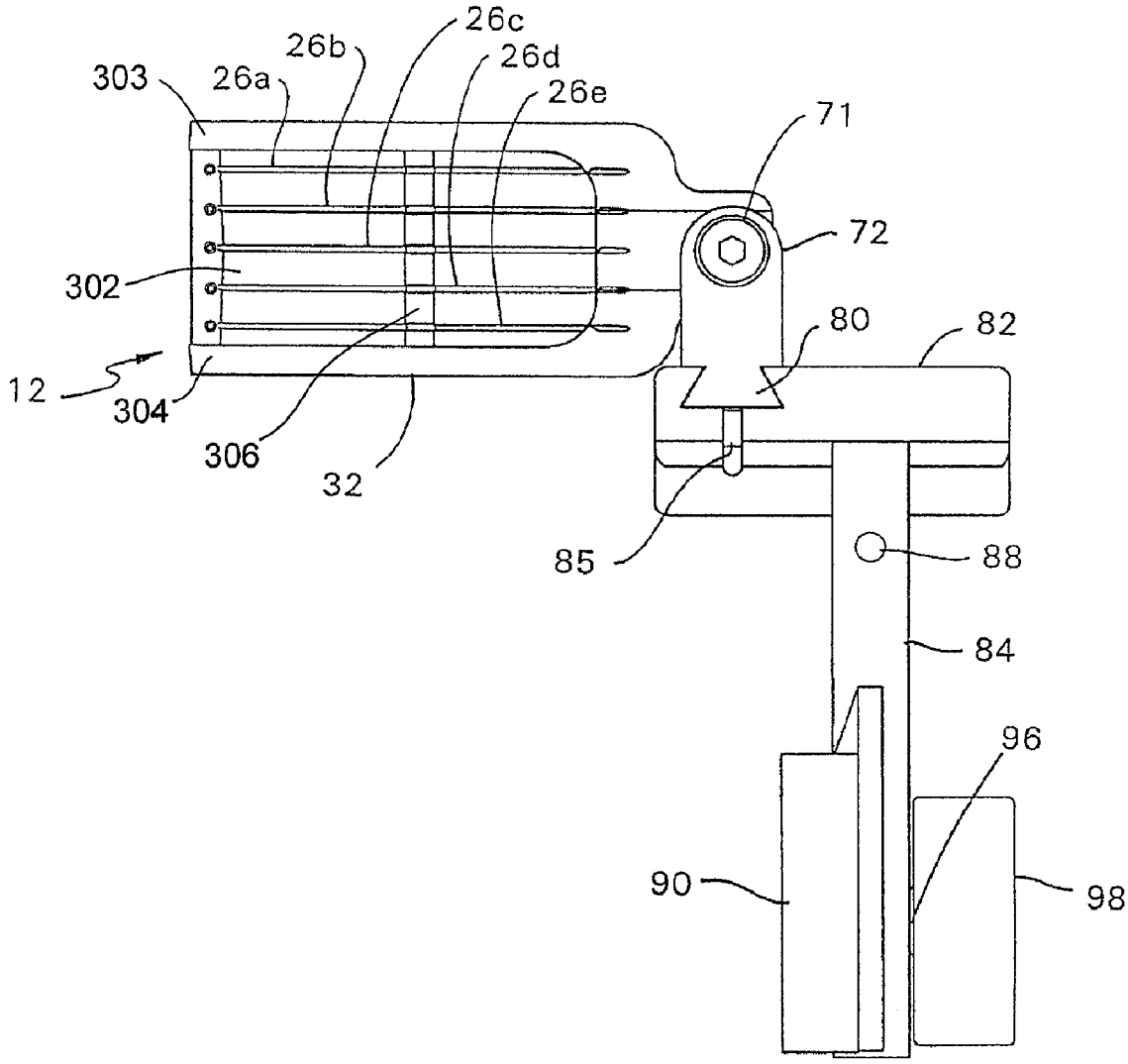
FIG. 2 is a top view of a bow sight according to the principles of the present invention.
Figure 4:
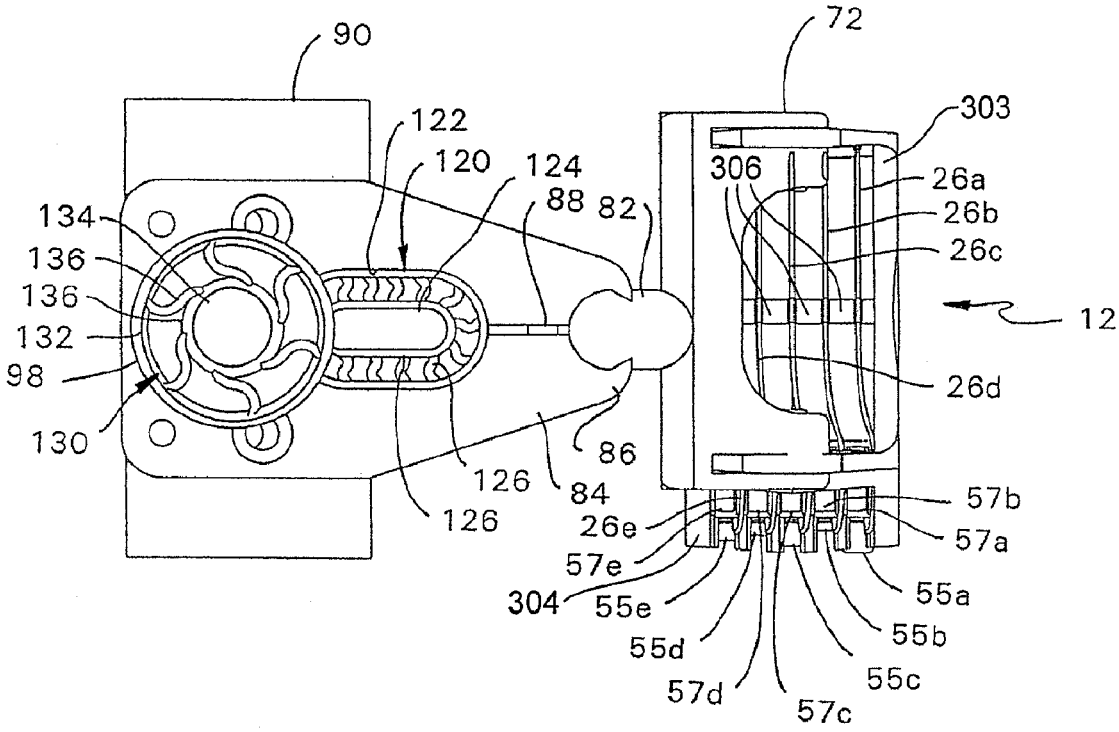
FIG. 4 is a right side view of a bow sight according to the principles of the present invention.
Figure 7:
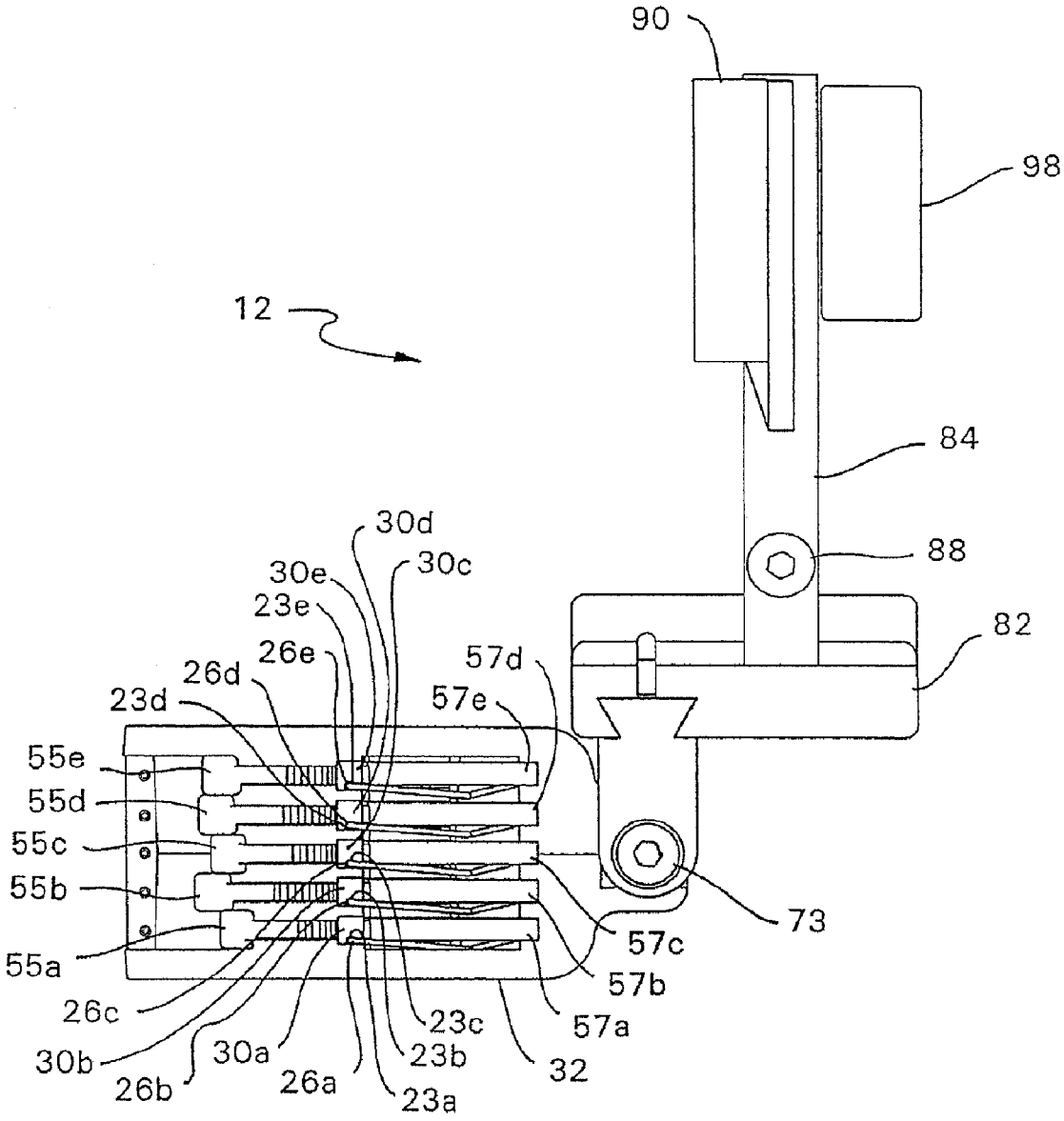
FIG. 7 is a bottom view of a bow sight according to the principles of the present invention.

Fiber optic cables 26*a-e* are mounted around the perimeter of the support structure 32 as shown in FIGS. 1, 2, 4, 5 and 7. As the fibers 26*a-e* wrap about the perimeter of the support structure 32, the fibers 26*a-e* extend around a viewing opening 301 defined by the sight 12 (see FIG. 1). As best shown at FIGS. 1, 2 and 4, the portions of the fibers 26*a-e* that extend around the viewing opening 301 are located within a recessed region 302 positioned between outer flanges 303, 304 provided at the exterior of the support structure 32. As is visible at FIGS. 1, 2 and 4, the flanges 303, 304 extend about a majority of the perimeter of the support structure 32. Dividers 306 separate the fibers 26*a-e* from one another so as to define separate wrap locations. As shown in FIG. 7, the fiber optic cables 26*a-e* extend within grooves 23*a-e* in the vertical pins 30*a-e*. The fiber optic cables are bent 45-90 degrees such that the end of the light gathering cables then pass through the holes 62*a-e* in the end of the vertical pins 30*a-e* respectively. The ends of the fiber optic cables 26*a-e* are the sight points in a preferred embodiment.

Each archer tends to hold a bow differently from the next. Some archers tend to torque the bow one way or another in the horizontal plane while shooting an arrow. Such bow torque brings the vertical pins 30*a-e* out of alignment and causes inaccurate shooting.

It is important that vertical alignment of the vertical pins be accomplished so that accuracy in shooting the bow with the bow sight can be achieved. Two vertical pins are "vertically aligned" when they are in a single vertical line as viewed from the position of the archer while holding the bow in the shooting position (with the string drawn). Vertical pins that do not form a single line as viewed from the archer, but that through an adjustment can be brought into a single line from the view of the archer still fall within the definition of "vertically aligned".

In a preferred embodiment, all five vertical pins 26*a-e* are vertically aligned. While the vertical pins 26*a-e* may not initially form a single line as viewed from the archer in the shooting position, the bow sight can be adjusted to bring the five pins 26*a-e* into a single line as viewed from the archer in the shooting position as will be described below.

In a preferred embodiment shown most clearly in FIG. 6, the bow torque adjustment feature is embodied in the ability to rotate the support structure 32 about a vertical axis 70. This bow torque adjustment feature allows for adjustment of bow torque to ensure vertical alignment of the vertical pins 30*a-e*. By rotating the support structure 32 around the vertical axis 70, an archer can set the bow sight 12 such that when that archer shoots the bow the vertical pins 30*a-e* all appear in a single line as viewed from the archer when shooting the bow.

In a preferred embodiment as shown in FIG. 6, the support structure 32 includes an upper sleeved arm 74 and a lower sleeved arm 76. Sleeve member 72 is rotationally connected to the support structure 32 along axis 70 by torque adjustment screw 71 and a torque adjustment screw 73 which both extend linearly along the vertical axis 70. An archer can loosen both torque adjustment screws 71 and 73 with an allen wrench (or by other means depending on the type of screw used) and then make the rotational adjustment between the sleeve member 72 and the support structure 32 as is necessary to bring the vertical pins 30*a-e* into vertical alignment in the shooting position. Once the correct rotational position is achieved, the torque adjustment screws 71 and 73 are tightened to prevent the sleeve member 72 and support structure 32 from rotating relative to one another.

FIG. 6 is a rear view of a bow sight according to the principles of the present invention. FIG. 6 includes a bow torque indicator 77 (not shown on the other drawings). A bow torque indicator is any vertical member that indicates to the archer whether there is bow torque. In a preferred embodiment as shown in FIG. 6, the bow torque indicator is a vertical wire 79 situated behind the vertical pins 30*a-e*. In a preferred embodiment, the vertical wire 79 is aircraft cable with a diameter of 0.030 inches. The vertical wire 79 is attached to the support structure by screws 81 and 83.

If bow torque is being applied to the bow, the archer will see that the vertical pins 30*a-e* are not lined up in a single vertical line with the bow torque indicating wire 79. The archer will then know that bow torque adjustment is required.

The attachment of the sleeve member 72 and support structure 32 to the bow is now described. The sleeve member 72 includes a double dove tail portion 80 that is received by a double dove tail recess in horizontal bar 82. A screw 85 allows for tightening and loosening of the sliding interaction between the double dove tail 80 and the double dove tail recess in the horizontal bar 82. The vertical position of the sleeve member 72 can therefore be adjusted relative to the horizontal bar 82. The horizontal bar 82 is received by an extender member 84 that has one end with an adjustable jaw 86 for holding and supporting the horizontal bar 82. The jaw 86 is adjustable via the screw 88. Thus, the horizontal bar 82 can be positionally adjusted horizontally from left to right as viewed from the archer in the shooting position.

The extender member 84 is releasably and adjustably connected to base 90. As shown in FIG. 6, extender 84 has a double dove tail 92 that is received by the double dove tail recess 94 of the base 90. Therefore, extender 84 is slidably received by the base 90 such that the base 90 and the extender 84 can be horizontally moved relative to one another toward and away from the archer.

Figure 3:
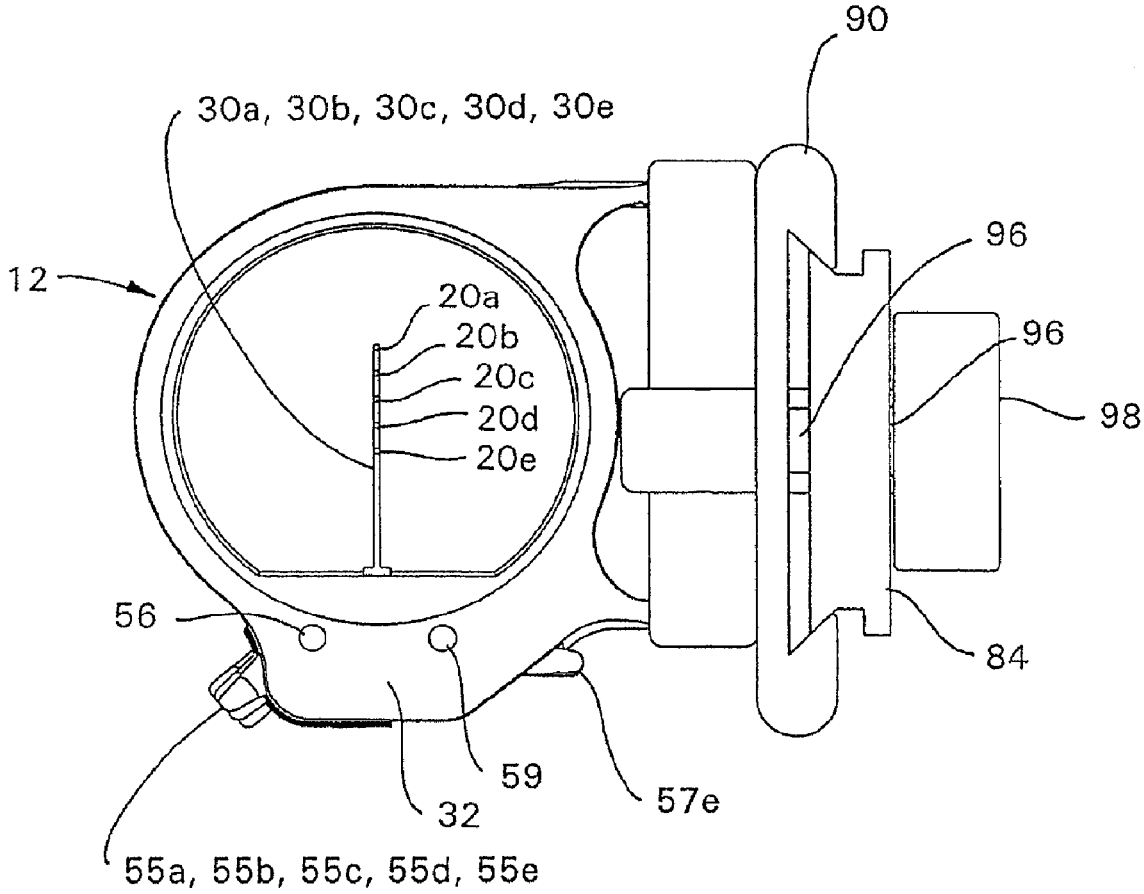
FIG. 3 is a front view of a bow sight according to the principles of the present invention.

As shown in FIG. 3, once the desired position of the extender 84 relative to the base 90 is determined, the extender 84 is nonslidably secured to the base 90 by screw 96 having adjustment knob 98. By tightening the adjustment knob 98, the screw 96 extends into a small recess (not shown) in the base 90 to prevent sliding movement between the extender 84 and the base 90.

Figure 5:
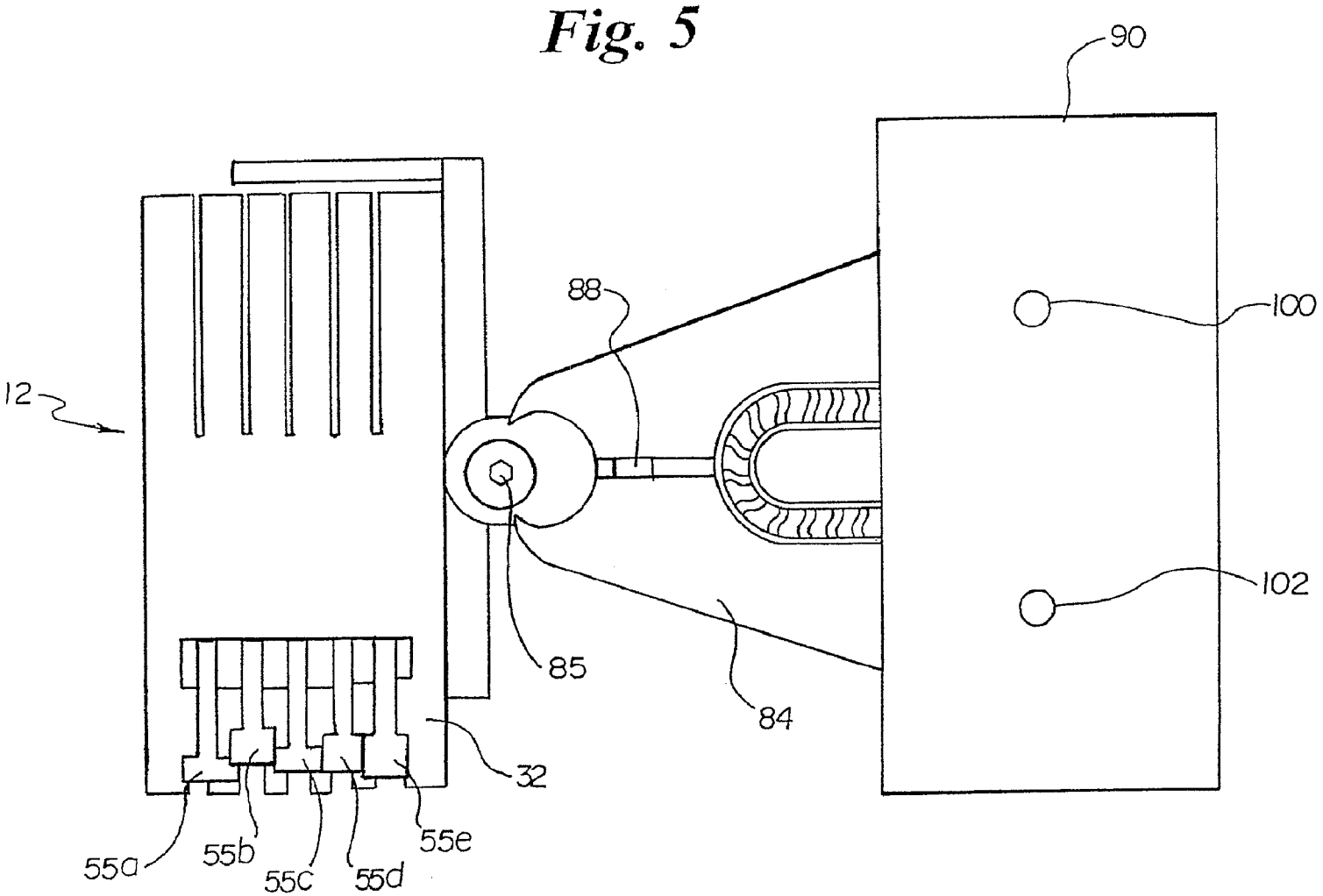
FIG. 5 is a left side view of a bow sight according to the principles of the present invention.

The base 90 is secured to the bow with two screws that pass through holes 100 and 102 and into the bow (see FIG. 5).

When the string on a bow is released, it creates significant vibrations. It is desired to reduce the vibrations for enhanced performance of the bow. In a preferred embodiment, dampeners are provided on the bow site. A dampener is any device which includes at least some material that is softer than the material that makes up the part of the bow sight to which the device is directly attached, such that the device at least partially absorbs the vibrations caused by the release of the bow string when shooting an arrow. Dampeners may be placed in the support structure itself or in any of the various members that connect the support structure to the bow.

In a preferred embodiment shown in FIG. 4, a dampener 120 is secured in a recess 122 in the extender 84. The recess 122 and the dampener 120 are oval in shape but could be any shape. The dampener 120 comprises a brass core 124 surrounded by a webbed rubber member 126 around the perimeter of the brass core 124. Alternate materials can certainly be used for the dampener. For example, the core could be aluminum with an outer perimeter material of plastic.

In a preferred embodiment also shown in FIG. 4, dampener 130 is secured in a recess 132 in the adjustment knob 98. The dampener 130 and recess 132 in this embodiment are circular in shape but again could be any shape. The dampener 130 includes a brass core 134 and a webbed rubber member 136 around the perimeter of the brass core 134.

While particular locations of the dampeners 120 and 130 connected to the support structure 32 have been provided in the drawings, it is noted that dampeners may be connected to the support structure 32 in many different locations. For example, a dampener could be set in a recess (not shown) in the support structure 32.

Figure 8:
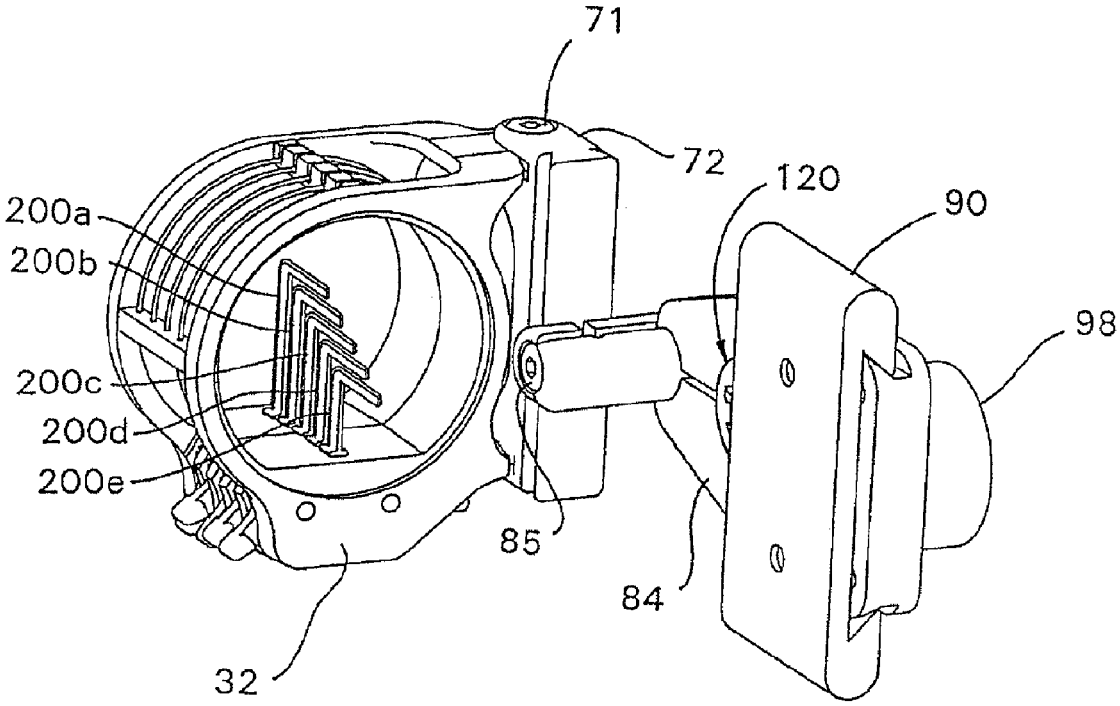
FIG. 8 is a perspective view of an alternate embodiment of a bow sight according to the principles of the present invention.

FIG. 8 is a perspective view of an alternative embodiment of the present invention. The difference between FIG. 1 and FIG. 8 is that the vertical pins 200*a-e* in FIG. 8 are L-shaped. That is, the vertical pins 200*a-e* have a vertical portion and also a horizontal portion. The horizontal portion extends in the direction towards the archer when the archer is standing in the shooting position.

In a preferred embodiment as shown in FIG. 8, the sight points 202*a-e* associated respectively with the vertical ins 200*a-e* are all in the same vertical plane.

FIGS. 10*a-d* show a preferred embodiment of a vertical pin 30*a* from the rear, front, left and right views respectively. The fiber optic cable 26*a* can also be seen in its relationship to the vertical pin 30*a*.

It is also noted that in an alternative preferred embodiment, the vertical pins 30*a-e* are protected by a circular and planar piece of non-opaque plexiglass. The plexiglass (not shown) fits within the rim 11 of the support structure 32 (see FIG. 1). A similar piece of plexiglass may be placed on the back side of the support structure 32.

In a preferred embodiment of the bow sight of the invention, the vertical pins, pin height adjustment levers, cam lock mechanisms and the support structure are made of acrylic plastic. It should be appreciated, however, that this invention is not limited by the type of material used for its parts. Many alternative materials can be used. For example, in an alternative embodiment these parts could be made of aluminum or any other material that can structurally perform the functions of these parts.

In a preferred embodiment, the sleeve member 72, horizontal bar 82, extender 84, base 90, and adjustment knob 98 are made of aluminum.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

The invention claimed is:

1. A bow sight, comprising:

a first pin supporting a first sight point;

a second pin supporting a second sight point;

a third pin supporting a third sight point;

wherein said first, second and third pins are aligned along a vertical plane viewed by the archer while holding the bow in a shooting position, and wherein said first, second and third pins are constructed of a non-fiber optic material; wherein said first, second and third sight pins are vertically movable relative to one another along the vertical plane.

2. The bow sight of claim 1, wherein said first, second and third sight pins are made of metal.

3. The bow sight of claim 2, wherein said first, second and third sight pins are made of aluminum.

4. The bow sight of claim 1, comprising a support structure with a generally circular shaped piece defining a viewing opening through which a target can be viewed, wherein said first, second and third sight pins are mounted to said support structure and extend into said viewing opening.

5. The bow sight of claim 1, wherein said third pin is longer than said second pin.

6. The bow sight of claim 5, wherein said second pin is longer than said first pin.

7. The bow sight of claim 4, comprising a plurality of sight pins mounted to said support structure and extending into said viewing opening.

8. The bow sight of claim 7, wherein each sight pin has a different length than the remainder of said plurality of sight pins.

9. The bow sight of claim 8, wherein said plurality of sight pins are vertically adjustable relative to one another along the vertical plane.

* * * * *